US009039051B2

(12) United States Patent
Shen

(10) Patent No.: US 9,039,051 B2
(45) Date of Patent: May 26, 2015

(54) PUSH/PULL OPERATING DEVICE FOR DRIVING A LATCH DEVICE

(71) Applicant: I-TEK METAL MFG. CO., LTD., Tainan (TW)

(72) Inventor: Jimmy Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 316 days.

(21) Appl. No.: 13/781,817

(22) Filed: Mar. 1, 2013

(65) Prior Publication Data

US 2014/0246872 A1 Sep. 4, 2014

(51) Int. Cl.
*E05B 3/00* (2006.01)
*E05B 7/00* (2006.01)
*E05B 65/10* (2006.01)

(52) U.S. Cl.
CPC . *E05B 7/00* (2013.01); *Y10S 292/65* (2013.01)

(58) Field of Classification Search
CPC ..... Y10T 29/49863; E05B 85/16
USPC ..... 292/92–94, 336.3, 347, DIG. 65, 348, 292/354; 70/92
See application file for complete search history.

(56) References Cited

U.S. PATENT DOCUMENTS 3,518,854 A * 7/1970 Krantz ..... 70/149
3,655,230 A * 4/1972 Armstrong ..... 292/169
3,785,686 A * 1/1974 Armstrong ..... 292/336.3
4,003,593 A * 1/1977 Wilzig et al. ..... 292/92
4,007,954 A * 2/1977 Erickson ..... 292/165
4,629,228 A * 12/1986 Marko et al. ..... 292/165
4,986,583 A * 1/1991 Campbell et al. ..... 292/336.3
5,085,474 A * 2/1992 Toledo et al. ..... 292/92
5,403,047 A * 4/1995 Walls ..... 292/173
5,609,372 A * 3/1997 Ponelle ..... 292/200
5,730,478 A 3/1998 D'Hooge ..... 292/348
6,196,599 B1 * 3/2001 D'Hooge ..... 292/165
6,293,598 B1 * 9/2001 Rusiana ..... 292/143
7,258,374 B2 * 8/2007 Rusiana ..... 292/336.3
8,424,928 B2 * 4/2013 Lin ..... 292/92
2006/0261608 A1 * 11/2006 Rusiana ..... 292/336.3
2013/0076046 A1 * 3/2013 Shah et al. ..... 292/336.3

* cited by examiner

*Primary Examiner* — Kristina Fulton
*Assistant Examiner* — Faria Ahmad
(74) *Attorney, Agent, or Firm* — Alan D. Kamrath; Kamrath IP Lawfirm, P.A.

(57) ABSTRACT

A push/pull operating device includes first and second operational devices mounted to two sides of a door. The first operating device includes a first bracket having a plurality of non-circular mounting holes. Two engaging rods extend through two of the mounting holes of the first bracket, the door, and a latch device mounted in the door. Each engaging rod has a limiting portion fixedly received in one of the mounting holes. A head of each engaging rod presses against the first bracket. The second operational device includes a second bracket having a plurality of non-circular mounting holes. A bolt is extended through one of the mounting holes of the second bracket and the door and engaged with one of the engaging rods. A head of each bolt presses against the second bracket. Thus, the first and second brackets are securely fixed to the sides of the door.

2 Claims, 12 Drawing Sheets

PUSH/PULL OPERATING DEVICE FOR DRIVING A LATCH DEVICE

BACKGROUND OF THE INVENTION

The present invention relates to a push/pull operating device and, more particularly, to a push/pull operating device for retracting a latch by pushing or pulling a handle.

A type of push/pull operating device for driving a latch includes a handle that can be pushed or pulled to retract a latch of a latch device in a door and is generally used in hospitals. Specifically, a medical worker can open the door by pushing or pulling the handle with his or her arm to avoid his or her hands from being contaminated by bacteria or germs left on the handle, preventing his or her patients from contamination. The push/pull operating device includes first and second operational devices respectively mounted to two sides of the door. The latch device is mounted in a compartment of the door and includes through-holes for installing the first and second operational devices. Since the through-holes of latch devices produced by different manufacturers have different locations, a mounting board with a plurality of fixing holes is provided to each side of the door. A fastener is mounted in each fixing hole of one of the mounting boards aligned with a corresponding through-hole of the latch device. A screw is extended through each of associated fixing holes in the other mounting board. Thus, the mounting boards are fixed to two sides of the door. Then, the first and second operational devices are mounted to the mounting boards. However, the mounting boards result in an increase in the costs, and the engagement of the first and second operational devices and the mounting boards is not reliable.

Thus, a need exists for a novel push/pull operating device allowing easy installation while providing reliable engagement.

BRIEF SUMMARY OF THE INVENTION

The present invention solves this need and other problems in the field of easy, reliable installation operational devices of locks by providing a push/pull operating device including a first bracket having first and second surfaces. A pivot hole extends from the first surface through the second surface of the first bracket. A plurality of mounting holes is provided around the pivot hole of the first bracket and has non-circular cross sections. The first bracket further includes two lateral sides extending between the first and second surfaces of the first bracket. A wing is formed on each lateral side of the first bracket and includes an engagement hole. The first bracket is adapted to be mounted to a first side of a door. The pivot hole of the first bracket is adapted to align with a first through-hole in the first side of the door. Two of the plurality of mounting holes of the first bracket are adapted to align with two second through-holes in the first side of the door.

A first transmission member includes a pivotal portion pivotably received in the pivot hole of the first bracket. The first transmission member further includes a flange on an end of the pivotal portion of the first transmission member. A protrusion is formed on the flange of the first transmission member. A driving hole extends from an end face of the flange through an end face of the other end of the pivotal portion of the first transmission member. The flange of the first transmission member is located outside of the first surface of the first bracket. The pivotal portion of the first transmission member is adapted to be received in the first through-hole in the first side of the door.

A first end of a first spindle is engaged in the driving hole of the first transmission member. The first spindle and the first transmission member are jointly pivotable. A second end of the first spindle is adapted to be coupled to a follower of a latch device mounted in the door. The latch device includes a latch movable between a latching position outside the door and an unlatching position inside the door.

A first axle is pivotably received in the engagement holes of the wings of the first bracket. A first handle is pivotably mounted to the first axle. The first handle includes a base having inner and outer faces. An arm is formed on the outer face of the first handle. The first handle is pivotable about a pivot axis defined by the first axle between a release position and a pressing position.

A first actuating block is mounted to the inner face of the first handle. The first actuating block includes a pressing portion abutting the protrusion of the first transmission member. The first actuating block presses against and pivoting the first transmission member when the first handle pivots from the release position to the pressing position.

A second bracket includes first and second surfaces. A pivot hole extends from the first surface through the second surface of the second bracket. A plurality of mounting holes is provided around the pivot hole of the second bracket and has non-circular cross sections. The second bracket further includes two lateral sides extending between the first and second surfaces of the second bracket. A wing is formed on each lateral side of the second bracket and includes an engagement hole. The second bracket is adapted to be mounted to a second side of the door. The pivot hole of the second bracket is adapted to align with a third through-hole in the second side of the door. Two of the plurality of mounting holes of the second bracket are adapted to align with two fourth through-holes in the second side of the door.

A second transmission member includes a pivotal portion pivotably received in the pivot hole of the second bracket. The second transmission member further includes a flange on an end of the pivotal portion of the second transmission member. A protrusion is formed on the flange of the second transmission member. A driving hole extends from an end face of the flange through an end face of the other end of the pivotal portion of the second transmission member. The flange of the second transmission member is located outside of the first surface of the second bracket. The pivotal portion of the second transmission member is adapted to be received in the third through-hole in the second side of the door.

A first end of a second spindle is engaged in the driving hole of the second transmission member. The second spindle and the second transmission member are jointly pivotable. A second end of the second spindle is adapted to be coupled to the follower of the latch device. A second axle is pivotably received in the engagement holes of the wings of the second bracket.

A second handle is pivotably mounted to the second axle. The second handle includes a base having inner and outer faces. An arm is formed on the outer face of the second handle. The second handle is pivotable about a pivot axis defined by the second axle between a release position and a pressing position.

A second actuating block is mounted to the inner face of the second handle. The second actuating block includes a pressing portion abutting the protrusion of the second transmission member. The second actuating block presses against and pivots the second transmission member when the second handle pivots from the release position to the pressing position.

Two engaging rods are provided. Each engaging rod includes a body, a head, and a limiting portion between the body and the head. An abutment face is formed at an intersection of the body and the head. The limiting portion of each engaging rod includes non-circular cross sections and is not rotatably received in one of the plurality of mounting holes of the first bracket. The abutment face of each engaging rod abuts the first surface of the first bracket. The bodies of the engaging rods are adapted to extend through the second through-holes in the first side of the door and extend through two through-holes of the latch device.

Two bolts are engaged with the engaging rods. Each bolt includes a head abutting the first surface of the second bracket. The two bolts are adapted to extend through the fourth through-holes in the second side of the door and the through-holes of the latch device.

The latch moves between the latching position and the unlatching position when either of the first and second spindles pivots. When each bolt is in a tightened state, the head of each engaging rod presses against the first bracket, and the head of each bolt presses against the second bracket. Thus, the first and second brackets are securely fixed to the sides of the door.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
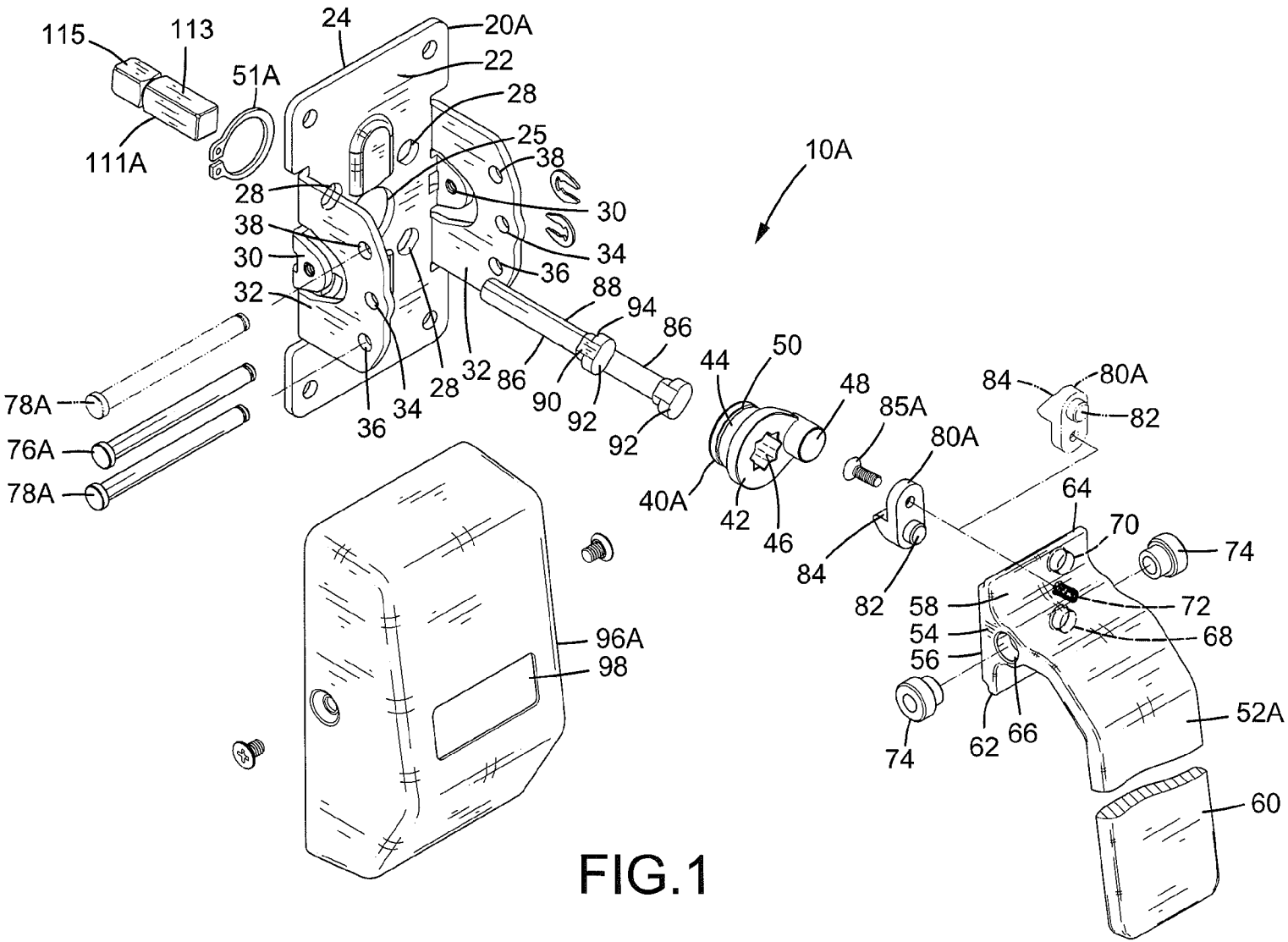
FIG. 1 shows an exploded, perspective view of a first operational device of a push/pull operating device according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "inner", "outer", "lower", "upper", "side", "end", "portion", "section", "vertical", "circumferential", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

A push/pull operating device according to the present invention is mounted to a door 116 having first and second sides 117 and 119 and an end face 131 extending between first and second sides 117 and 119. Door 116 further includes a compartment 133 between first and second sides 117 and 119 and spaced from end face 131. Door 116 further includes a first through-hole 135A and two second through-holes 137A, with each of first and second through-holes 135A and 137A extending from first side 117 to compartment 133, and with first through-hole 135A located between second through-holes 137A. Door 116 further includes a third through-hole 135B and two fourth through-holes 137B, with each of third and fourth through-holes 135B and 137B extending from second side 119 to compartment 133, with third through-hole 135B located between fourth through-holes 137B, with first through-hole 135A aligned with third through-hole 135B, and with each second through-hole 137A aligned with one of fourth through-holes 137B.

Figure 5:
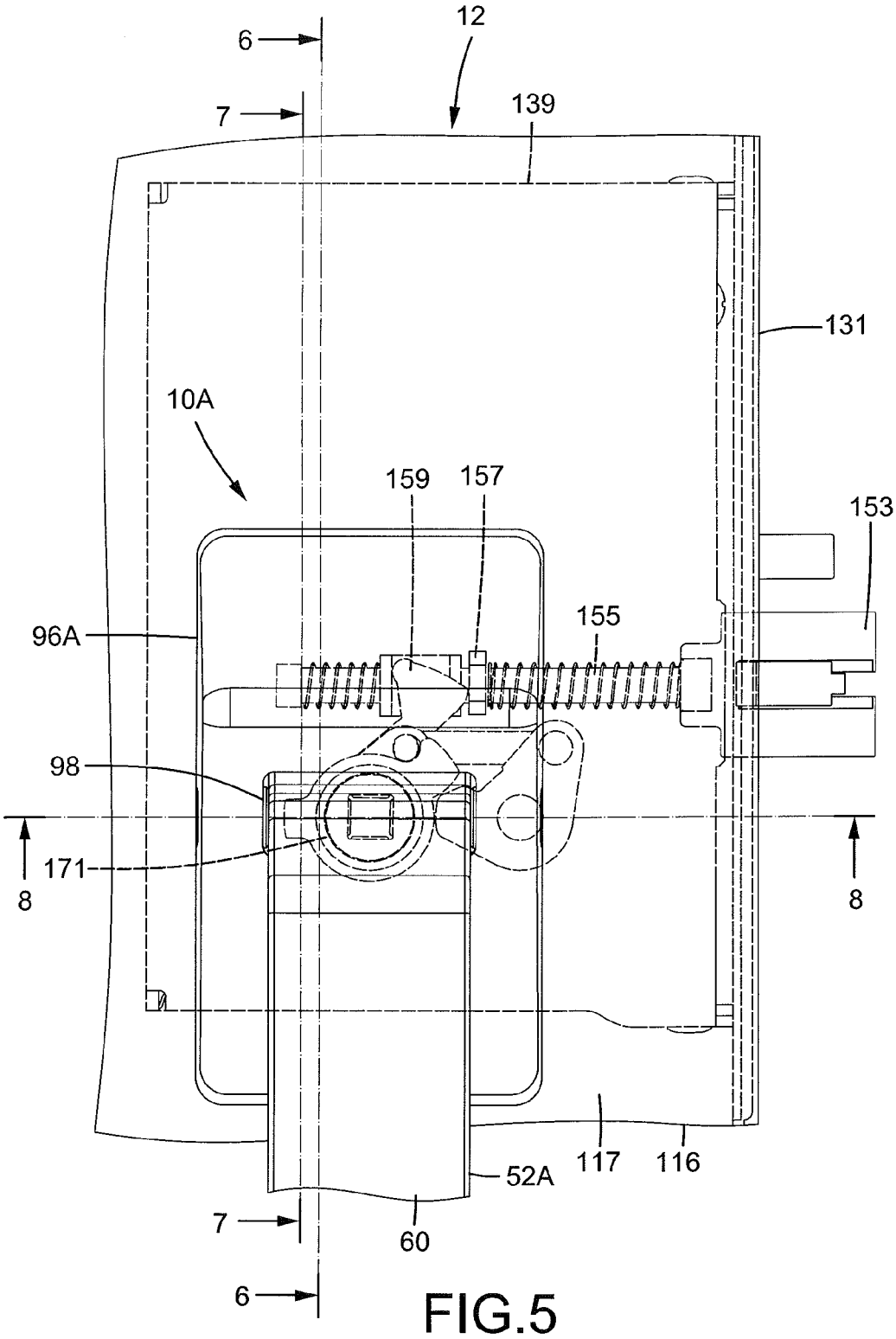
FIG. 5 shows a partial, side view of the door and the push/pull operating device of FIG. 4.
Figure 12:
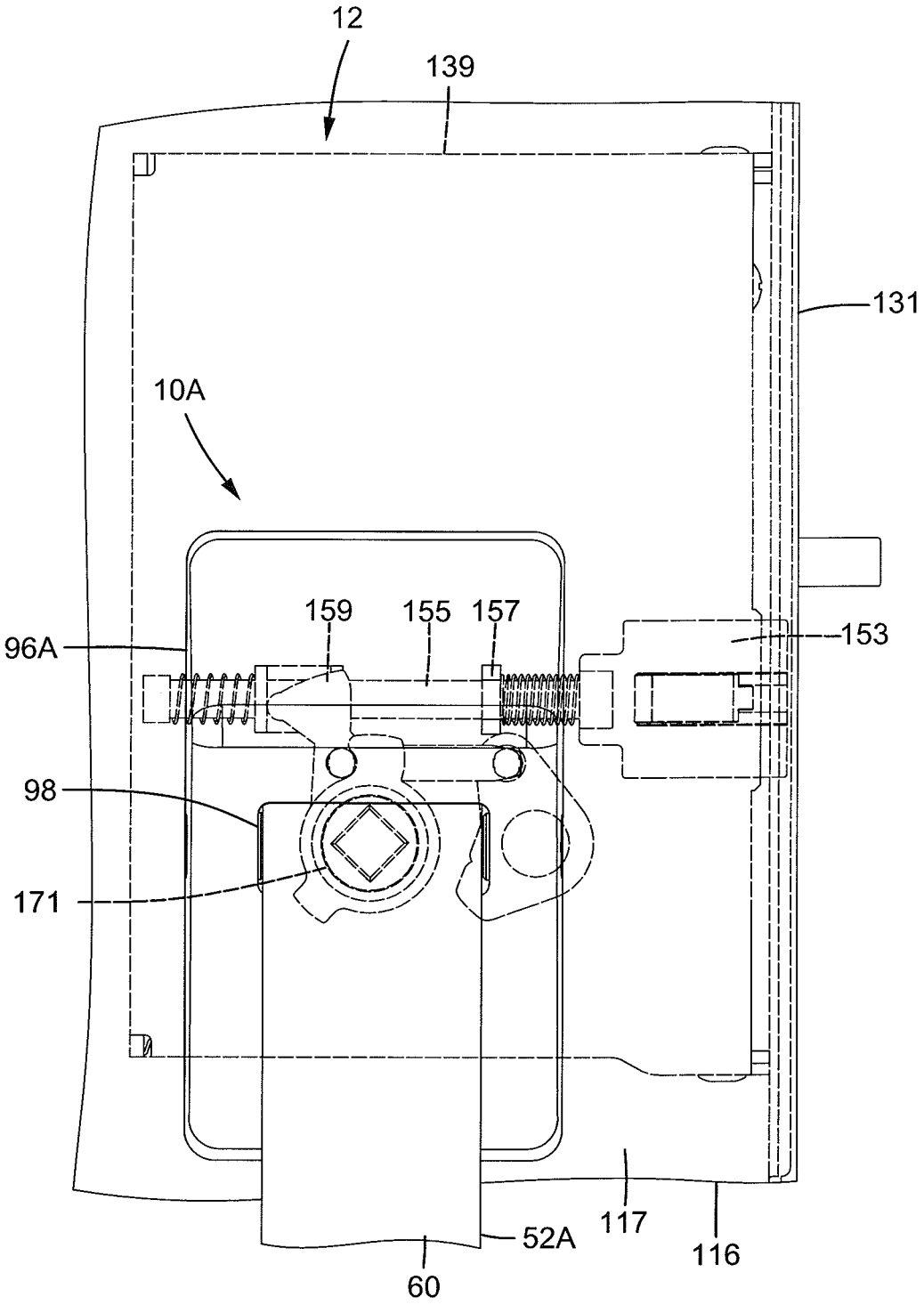
FIG. 12 shows a view similar to FIG. 5, with the first handle or the second handle pivoted to the pressing position, and with a latch of the latch device retracted.

The push/pull operating device includes a first operational device 10A mounted to first side 117 of door 116 and a second operational device 10B mounted to second side 119 of door 116. A latch device 12 is mounted in compartment 133 of door 116. Latch device 12 includes a case 139 having two through-holes 151 respectively aligned with second and fourth through-holes 137A and 137B. Latch device 12 further includes a latch 153 having a shank 155 received in case 139. An actuation member 157 is coupled to shank 155, allowing joint movement of shank 155 and actuation member 157. A driving board 159 is pivotably mounted in case 139 and jointly moveable with actuation member 157. A follower 171 is coupled to driving board 159 and aligned with first and third through-holes 135A and 135B. Latch 153 is movable between a latching position outside end face 131 of door 116 (FIG. 5) and an unlatching position not extending beyond end face 131 of door 116 (FIG. 12). Latch 153 moves between the latching position and the unlatching position when driving board 159 pivots and causes movement of actuation member 157.

First operational device 10A includes a first bracket 20A having first and second surfaces 22 and 24. A pivot hole 25 extends from first surface 22 through second surface 24. A plurality of mounting holes 28 is provided around pivot hole 25 and spaced from each other along a circumferential direction about an axis of pivot hole 25. Each mounting hole 28 has non-circular cross sections. First bracket 20A further includes two lateral sides extending between first and second surfaces 22 and 24. A lug 30 is formed on each lateral side of first bracket 20A. A wing 32 is formed on each lateral side of first bracket 20A and around one of lugs 30. Each wing 32 has first and second limiting holes 36 and 38 spaced from each other in a vertical direction and an engagement hole 34 between first and second limiting holes 36 and 38.

First operational device 10A further includes a first transmission member 40A pivotably mounted in pivot hole 25 of first bracket 20A. First transmission member 40A includes a pivotal portion 44 and a flange 42 on an end of pivotal portion 44. An annular groove 50 is formed in an outer periphery of pivotal portion 44 and located adjacent to the other end of pivotal portion 44. A protrusion 48 is formed on flange 42. A driving hole 46 extends from an end face of flange 42 through an end face of the other end of pivotal portion 44. Flange 42 of first transmission member 40A is located outside of first surface 22 of first bracket 20A, and annular groove 50 is located outside of second surface 24 of first bracket 20A. A retaining ring 51A is mounted in annular groove 50 of first transmission member 40A, preventing first transmission member 40A from disengaging from pivot hole 25 of first bracket 20A.

First operational device 10A further includes a first spindle 111A having first and second ends 113 and 115. First end 113 of first spindle 111A is engaged in driving hole 46 of first transmission member 40A, allowing joint pivotal movement of first spindle 111A and first transmission member 40A.

A first handle 52A is pivotably mounted between wings 32 of first bracket 20A. First handle 52A includes a base 54 having inner and outer faces 56 and 58. Base 54 further includes upper and lower portions 64 and 62 and an intermediate portion between upper and lower portions 64 and 62. An arm 60 is formed on outer face 58 at the intermediate portion. First handle 52A further includes an axle hole 66 in the intermediate portion. A first positioning hole 68 is formed in inner face 56 at lower portion 62. A second positioning hole 70 is formed in inner face 56 at upper portion 64. A fixing hole 72 is formed in inner face 56 and located between first and second positioning holes 68 and 70.

Figure 10:
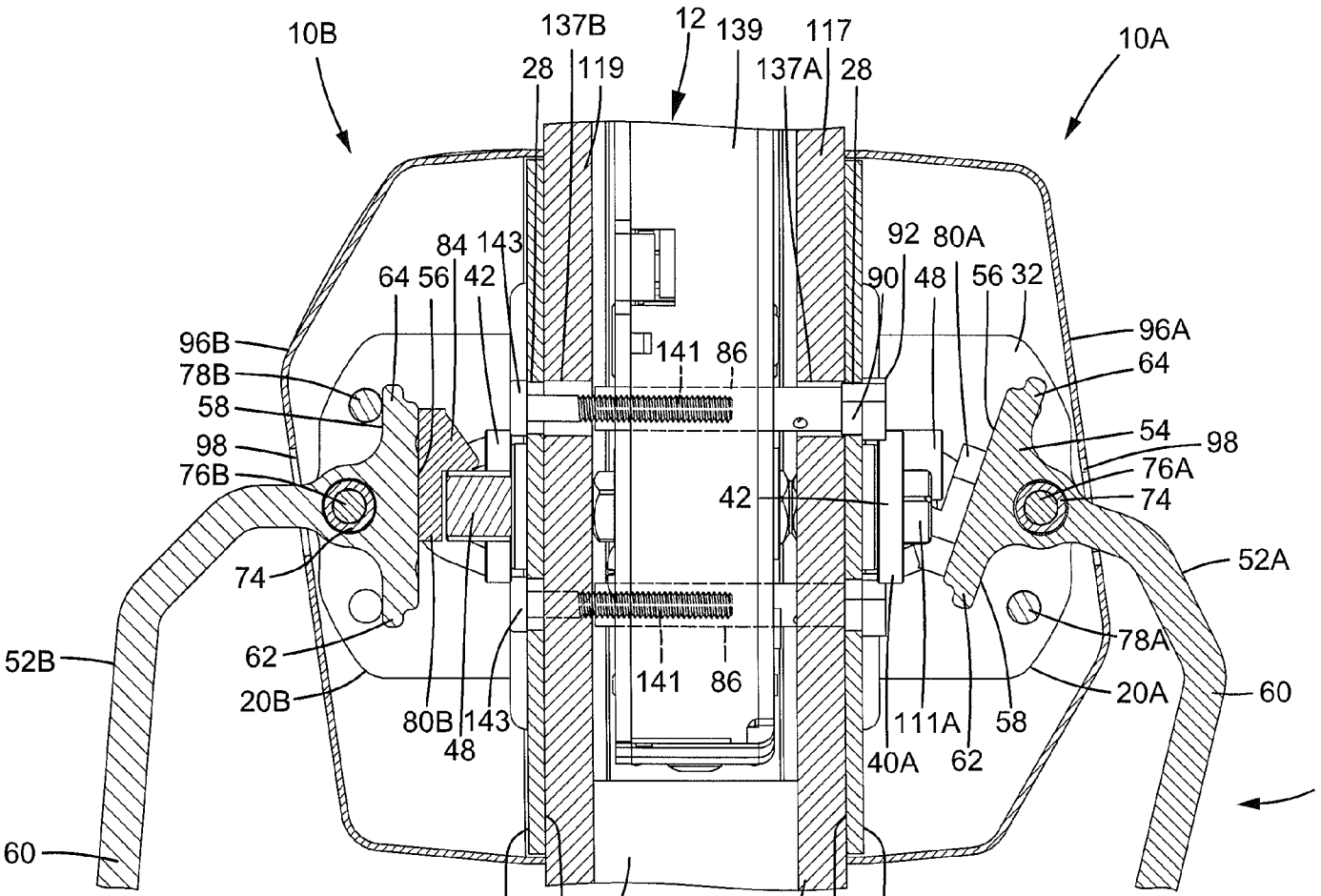
FIG. 10 shows a view similar to FIG. 7, with a first handle pivoted to a pressing position.

A sleeve 74 is mounted between each lateral side of first handle 52A and one of wings 32 of first bracket 20A and is pivotably mounted in axle hole 66. A first axle 76A is extended through axle hole 66 of first handle 52A and is extended through engagement holes 34 of wings 32 of first bracket 20A and is pivotably engaged with sleeves 74. Thus, first handle 52A is pivotable about a pivot axis defined by first axle 76A between a release position (FIG. 6) and a pressing position (FIG. 10).

A first limiting rod 78A is extended through first limiting holes 36 of wings 32 of first bracket 20A. When first handle 52A is in the release position, outer face 58 at lower portion 62 of first handle 52A abuts first limiting rod 78A, preventing arm 60 of first handle 52A from pivoting away from first surface 22 of first bracket 20A.

First operational device 10A further includes a first actuating block 80A fixed to inner face 56 of first handle 52A. A positioning peg 82 is formed on a side of first actuating block 80A. A pressing portion 84 is formed on the other side of first actuating block 80A. A screw 85A is extended through first actuating block 80A into fixing hole 72 of first handle 52A. Positioning peg 82 of first actuating block 80A is engaged in first positioning hole 68 of first handle 52A. Pressing portion 84 of first actuating block 80A abuts protrusion 48 of first transmission member 40A and located below protrusion 48 in the vertical direction. In this case, first handle 52A is of push type. Namely, when it is desired to pivot first handle 52A from the release position to the pressing position, arm 60 is pushed towards first surface 22 of first bracket 20A.

Second operational device 10B includes a second bracket 20B having first and second surfaces 22 and 24. A pivot hole 25 extends from first surface 22 through second surface 24. A plurality of mounting holes 28 is provided around pivot hole 25 and spaced from each other along a circumferential direction about an axis of pivot hole 25. Each mounting hole 28 has non-circular cross sections. Second bracket 20B further includes two lateral sides extending between first and second surfaces 22 and 24. A lug 30 is formed on each lateral side of second bracket 20B. A wing 32 is formed on each lateral side of second bracket 20B and around one of lugs 30 of second bracket 20B. Each wing 32 of second bracket 20B has first and second limiting holes 36 and 38 spaced from each other in the vertical direction and an engagement hole 34 between first and second limiting holes 36 and 38.

Second operational device 10B further includes a second transmission member 40B pivotably mounted in pivot hole 25 of second bracket 20B. Second transmission member 40B includes a pivotal portion 44 and a flange 42 on an end of pivotal portion 44. An annular groove 50 is formed in an outer periphery of pivotal portion 44 of second transmission member 40B and located adjacent to the other end of pivotal portion 44 of second transmission member 40B. A protrusion 48 is formed on flange 42 of second transmission member 40B. A driving hole 46 extends from an end face of flange 42 of second transmission member 40B through an end face of the other end of pivotal portion 44 of second transmission member 40B. Flange 42 of second transmission member 40B is located outside of first surface 22 of second bracket 20B, and annular groove 50 of second transmission member 40B is located outside of second surface 24 of second bracket 20B. A retaining ring 51B is mounted in annular groove 50 of second transmission member 40B, preventing second transmission member 40B from disengaging from pivot hole 25 of second bracket 20B.

Second operational device 10B further includes a second spindle 111B having first and second ends 113 and 115. First end 113 of second spindle 111B is engaged in driving hole 46 of second transmission member 40B, allowing joint pivotal movement of second spindle 111B and second transmission member 40B.

A second handle 52B is pivotably mounted between wings 32 of second bracket 20B. Second handle 52B includes a base 54 having inner and outer faces 56 and 58. Base 54 of second handle 52B further includes upper and lower portions 64 and 62 and an intermediate portion between upper and lower portions 64 and 62. An arm 60 is formed on outer face 58 at the intermediate portion of second handle 52B. Second handle 52B further includes an axle hole 66 in the intermediate portion. A first positioning hole 68 is formed in inner face 56 at lower portion 62 of second handle 52B. A second positioning hole 70 is formed in inner face 56 at upper portion 64 of second handle 52B. A fixing hole 72 is formed in inner face 56 of second handle 52B and located between first and second positioning holes 68 and 70.

Figure 11:
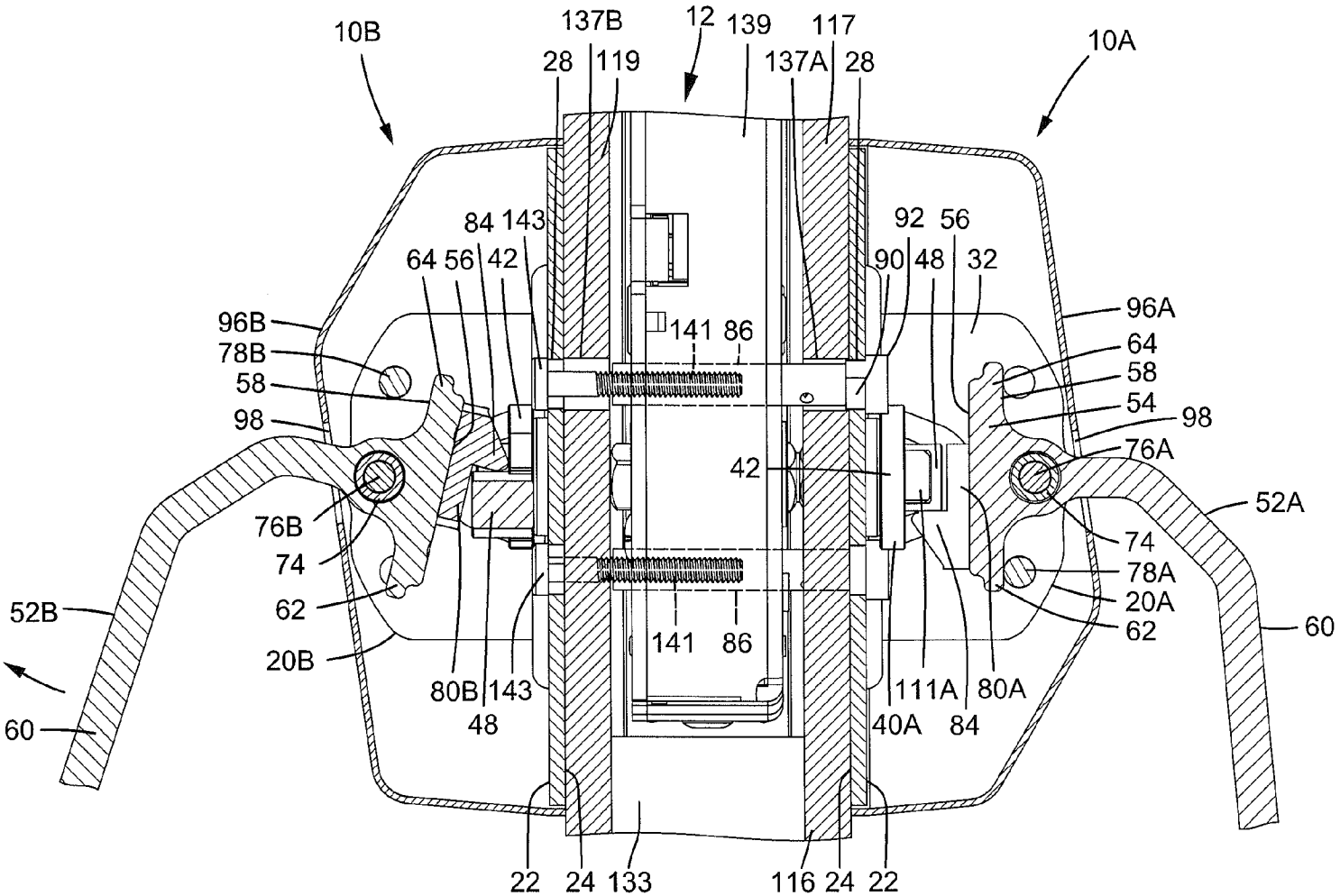
FIG. 11 shows a view similar to FIG. 7, with a second handle pivoted to a pressing position.

A sleeve 74 is mounted between each lateral side of second handle 52B and one of wings 32 of second bracket 20B and is pivotably mounted in axle hole 66 of second handle 52B. A second axle 76B is extended through axle hole 66 of second handle 52B and is extended through engagement holes 34 of wings 32 of second bracket 20B and is pivotably engaged with sleeves 74. Thus, second handle 52B is pivotable about a pivot axis defined by second axle 76B between a release position (FIG. 6) and a pressing position (FIG. 11).

A second limiting rod 78B is extended through second limiting holes 38 of wings 32 of second bracket 20B. When second handle 52B is in the release position, outer face 58 at lower portion 62 of second handle 52B abuts second limiting rod 78B, preventing arm 60 of second handle 52B from pivoting towards from first surface 22 of second bracket 20B.

Second operational device 10B further includes a second actuating block 80B fixed to inner face 56 of second handle 52B. A positioning peg 82 is formed on a side of second actuating block 80B. A pressing portion 84 is formed on the other side of second actuating block 80B. A screw 85B is extended through second actuating block 80B into fixing hole 72 of second handle 52B. Positioning peg 82 of second actuating block 80B is engaged in second positioning hole 70 of second handle 52B. Pressing portion 84 of second actuating block 80B abuts protrusion 48 of second transmission member 40B and located on top of protrusion 48 in the vertical direction. In this case, second handle 52B is of pull type. Namely, when it is desired to pivot second handle 52B from the release position to the pressing position, arm 60 of second handle 52B is pulled away from first surface 22 of second bracket 20B.

Figure 7:
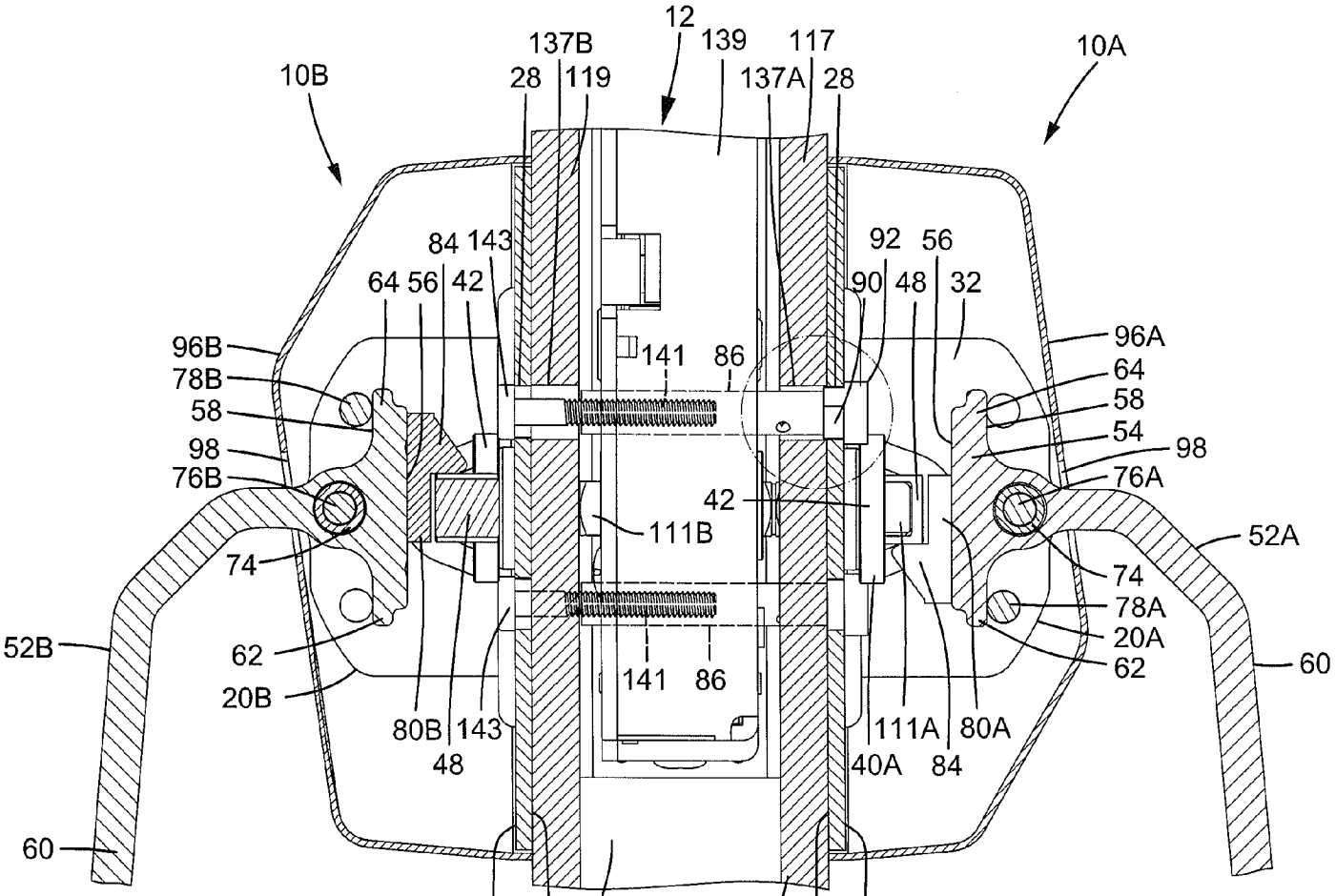
FIG. 7 is a cross sectional view taken along section line 7-7 of FIG. 5.
Figure 8:
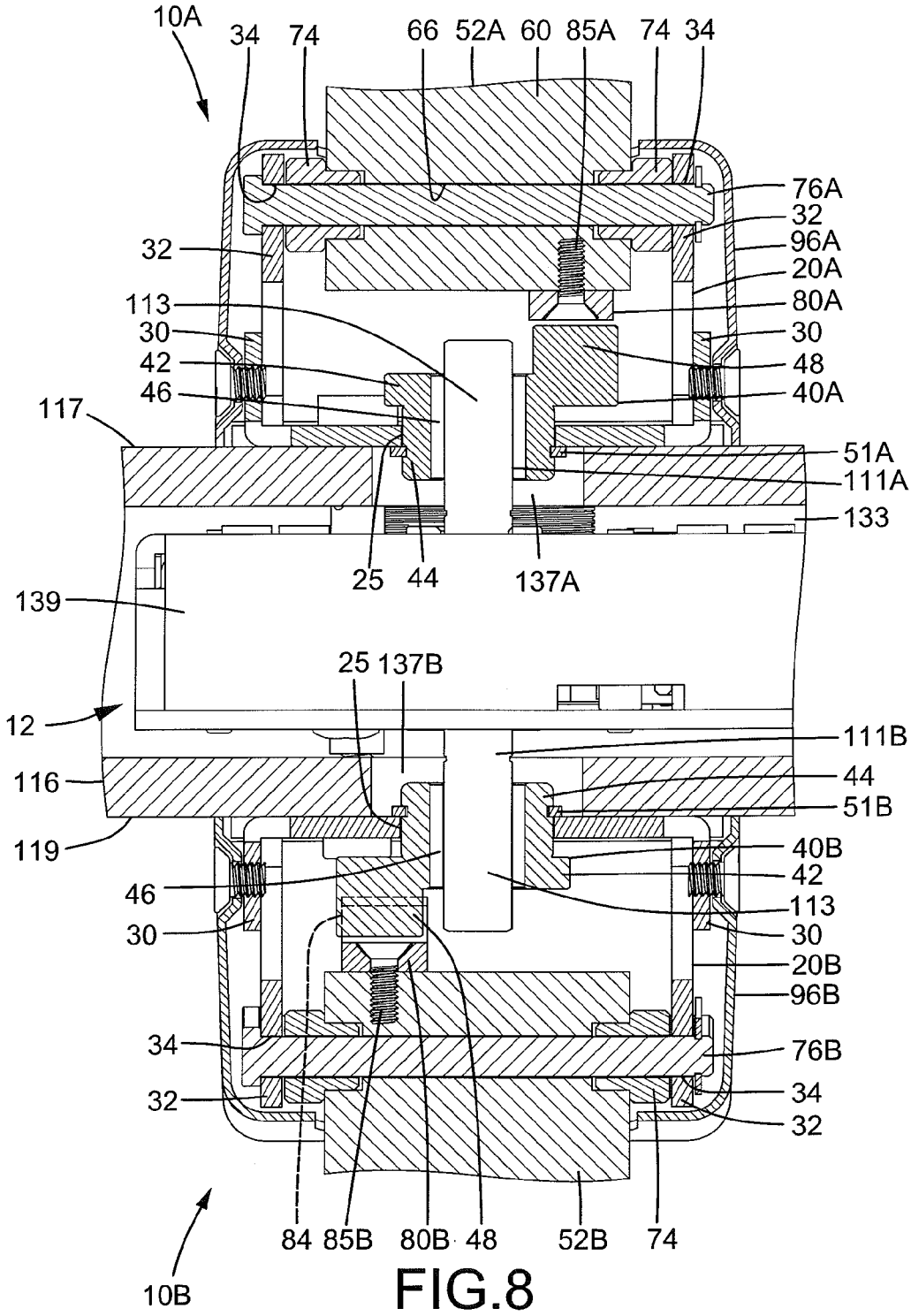
FIG. 8 is a cross sectional view taken along section line 8-8 of FIG. 5.

Push/pull operating device further includes two engaging rods 86 and two bolts 141. Each engaging rod 86 includes a body 88 and a head 92 having a diameter larger than a diameter of body 88. A limiting portion 90 is formed between body 88 and head 92 and has non-circular cross sections. Limiting portion 90 has a diameter smaller than the diameter of head 92. An abutment face 94 is formed at an intersection of limiting portion 90 and head 92. Each engaging rod 86 has a screw hole in the other end opposite to head 92 (FIG. 7).

Figure 9:
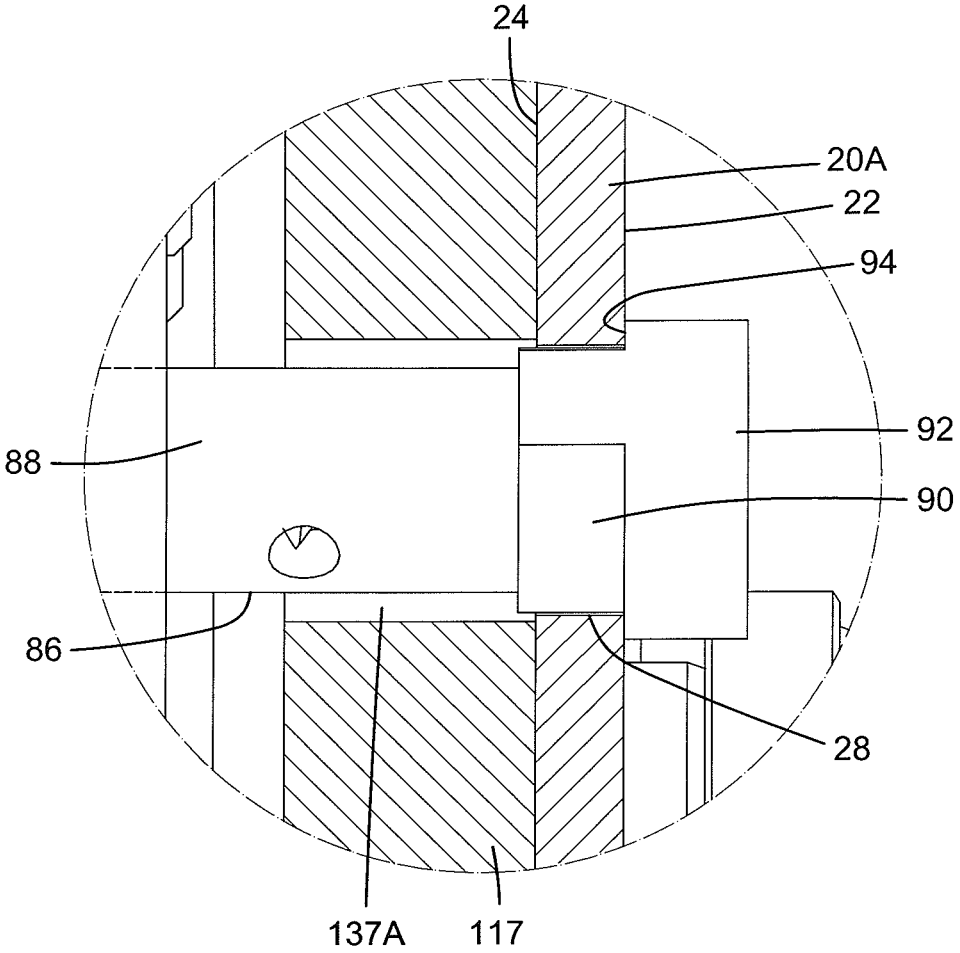
FIG. 9 shows an enlarged view of a circled portion in FIG. 7.

In assembly of first operational device 10A, second surface 24 of first bracket 20A abuts first side 117 of door 116, with two mounting holes 28 of first bracket 20A aligned with second through-holes 137A of door 116. Pivotal portion 44 of first transmission member 40A is received in first through-hole 135A of door 116. Second end 115 of first spindle 111A is extended through first through-hole 135A of first side 117 of door 116 and engages with follower 171 of latch device 12. Body 88 of each engaging rod 86 is extended through one of mounting holes 28 of first bracket 20A, one of second through-holes 137A, and one of through-holes 151 of latch device 12. After assembly, limiting portion 90 of each engaging rod 86 is fixedly received in one of mounting holes 28 of first bracket 20A, avoiding rotation of engaging rod 86. Abutment face 94 of each engaging rod 86 abuts first surface 22 of first bracket 20A (FIGS. 7 and 9).

Next, second surface 24 of second bracket 20B abuts second side 119 of door 116, with two mounting holes 28 of second bracket 20B aligned with fourth through-holes 137B of door 116. Pivotal portion 44 of second transmission member 40B is received in third through-hole 135B of door 116. Second end 115 of second spindle 111B is extended through third through-hole 135B of second side 119 of door 116 and engages with follower 171 of latch device 12. Each bolt 141 is extended through one of mounting holes 28 of second bracket 20B and one of fourth through-holes 137B of door 116 and engages with the screw hole in one of engaging rods 86 (FIG. 7). Since each engaging rod 86 is limited by an associated mounting hole 28 and, thus, can not rotate, each bolt 141 can be rotated and, thus, tightened. After tightening bolts 141, a head 143 of each bolt 141 presses against first surface 22 of second bracket 20B, and abutment face 94 of each engaging rod 86 presses against first surface 22 of first bracket 20A. Thus, first and second operational devices 10A and 10B tightly clamp door 116.

A first cover 96A is fixed by screws to lugs 30 of first bracket 20A. Arm 60 of first handle 52A extends through an opening 98 in first cover 96A. A second cover 96B is fixed by screws to lugs 30 of second bracket 20B. Arm 60 of second handle 52B extends through an opening 98 in second cover 96B.

Figure 6:
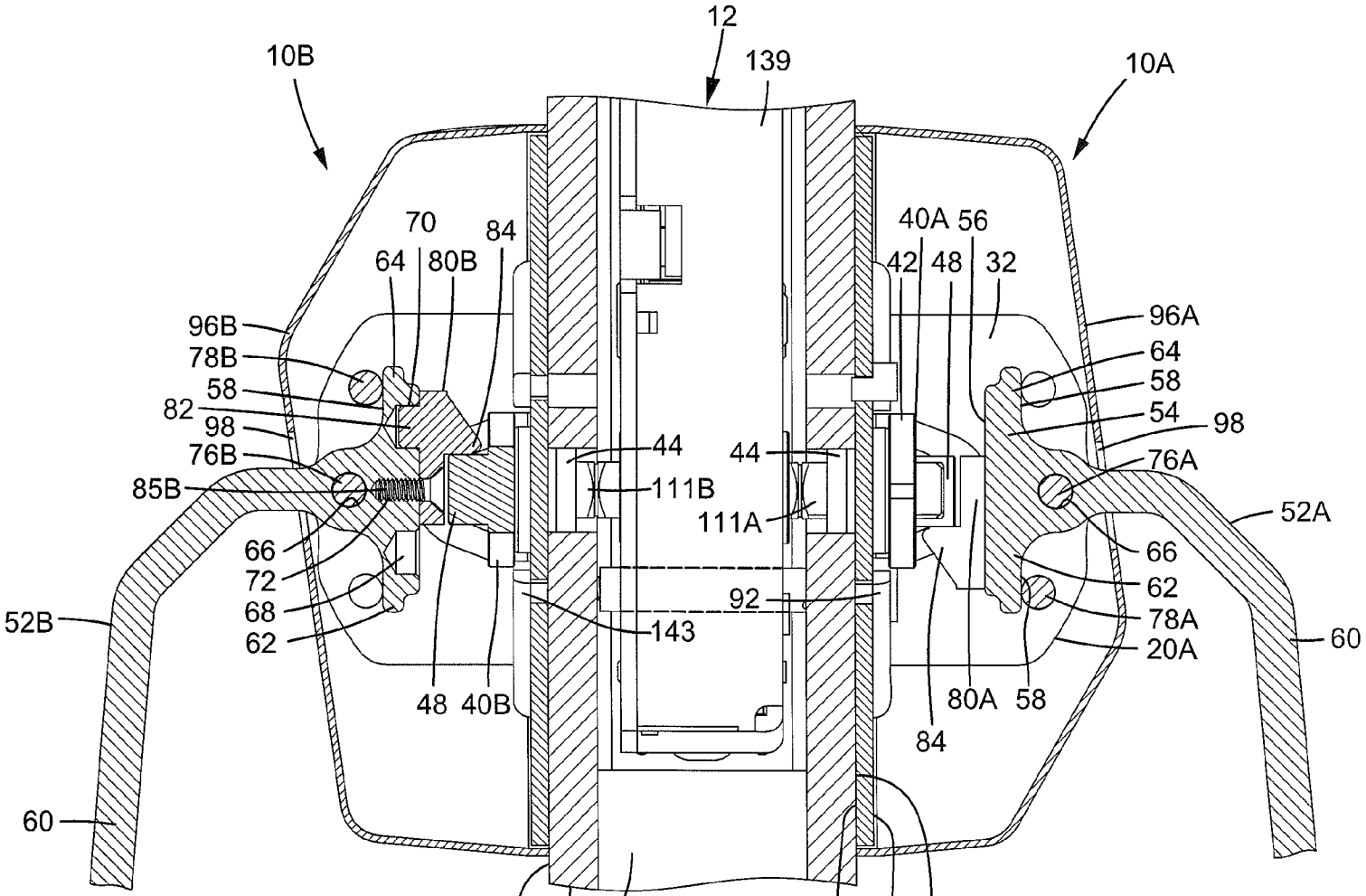
FIG. 6 is a cross sectional view taken along section line 6-6 of FIG. 5.

Now that the basic construction of the push/pull operating device has been explained, the operation and some of the advantages of the push/pull operating device can be set forth and appreciated. In particular, for the sake of explanation, it will be assumed that latch 153 of latch device 12 is in the latching position (FIG. 5), first operational device 10A is assembled to be of push type, and second operational device 10B is assembled to be of pull type (FIGS. 6 and 7). Furthermore, first and second handles 52A and 52B are in the release position (FIGS. 6 and 7).

A user at first side 117 of door 116 can open door 116 by operating first operational device 10A. The user can push first handle 52A to pivot first handle 52A from the releasing position (FIGS. 6 and 7) to the pressing position (FIG. 10), moving first actuating block 80A upward in the vertical direction and pressing against protrusion 48 of first transmission member 40A. First transmission member 40A causes movement of follower 171 and driving board 159, moving latch 153 from the latching position (FIG. 5) to the unlatching position (FIG. 12). Thus, door 116 can be pushed open by keep pushing first handle 52A. After the force imparted to first handle 52A vanishes, a return spring around shank 155 returns latch 153 to the latching position and returns first handle 52A to the release position.

If the user is at second side 119 of door 116, the user can open door 116 by operating second operational device 10B. The user can push second handle 52B to pivot second handle 52B from the releasing position (FIGS. 6 and 7) to the pressing position (FIG. 11), moving second actuating block 80B downward in the vertical direction and pressing against protrusion 48 of second transmission member 40B. Second transmission member 40B causes movement of follower 171 and driving board 159, moving latch 153 from the latching position (FIG. 5) to the unlatching position (FIG. 12). Thus, door 116 can be pulled open by keep pulling second handle 52B. After the force imparted to second handle 52B vanishes, the return spring around shank 155 returns latch 153 to the latching position and returns second handle 52B to the release position.

Figure 2:
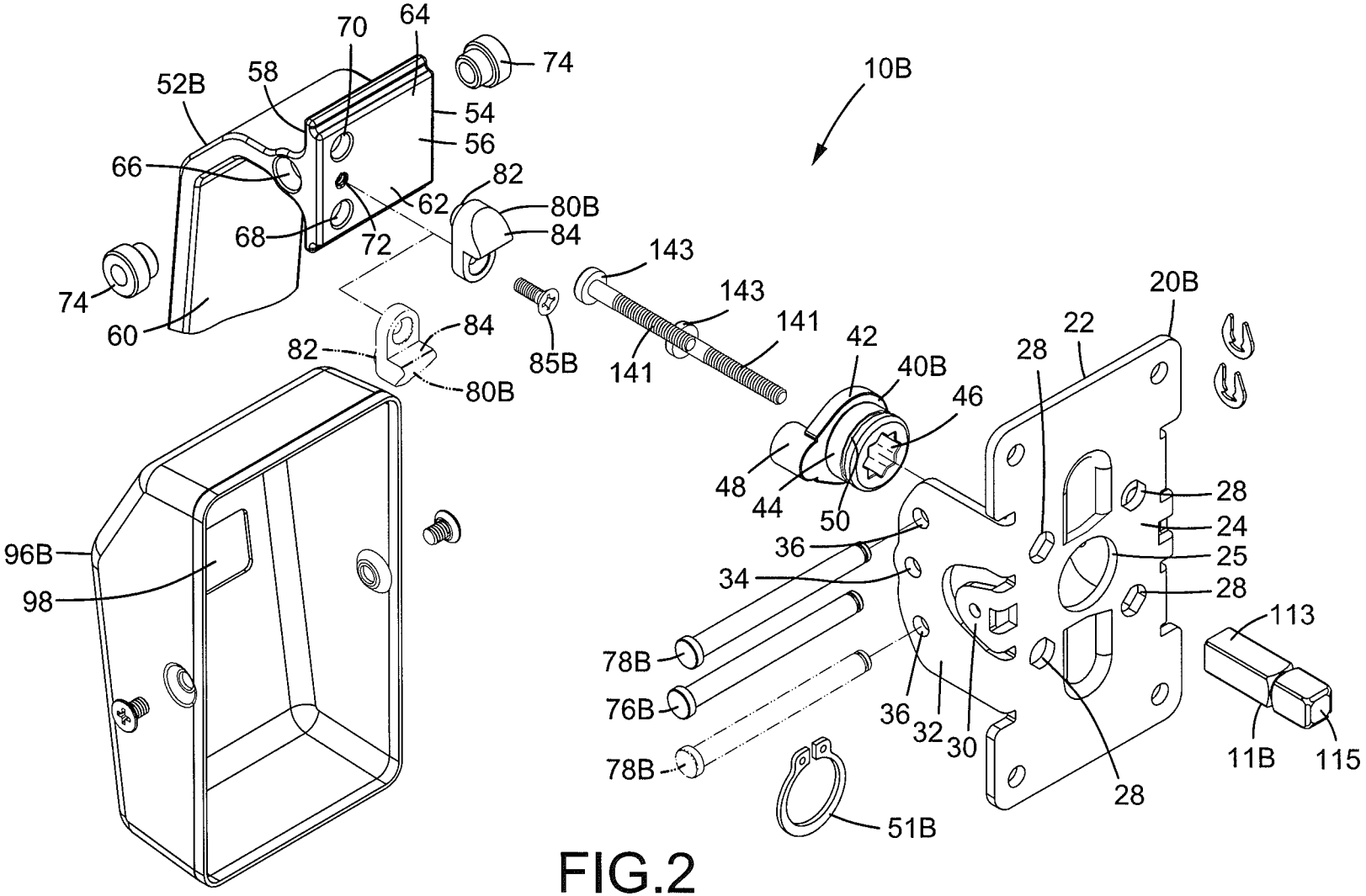
FIG. 2 shows an exploded, perspective view of a second operational device of the push/pull operating device according to the present invention.
Figure 3:
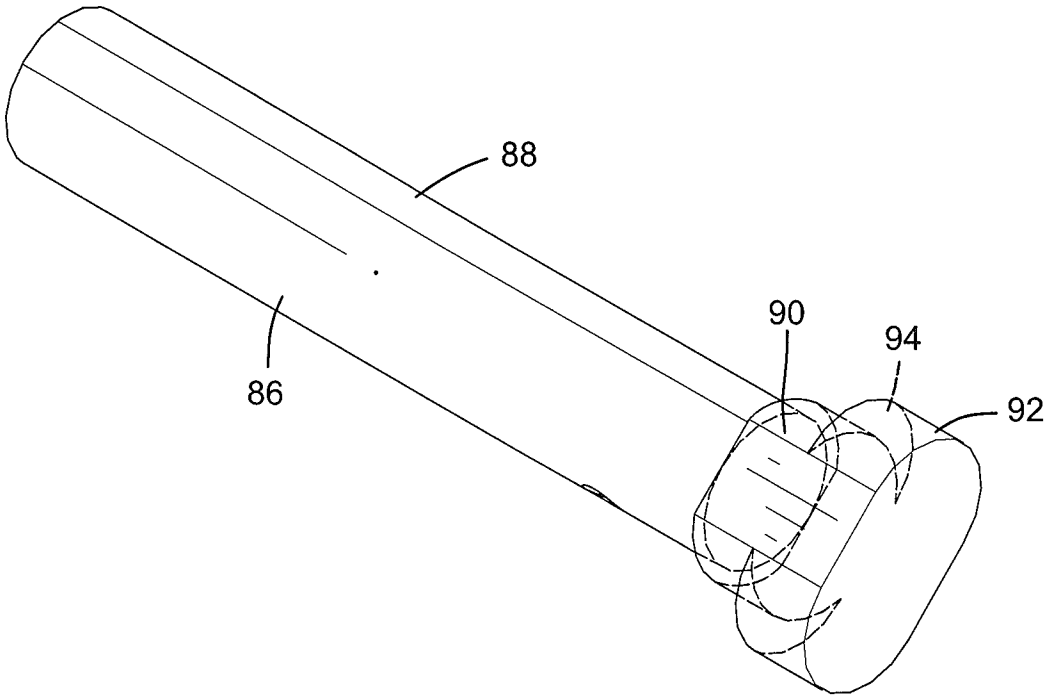
FIG. 3 shows a perspective view of an engaging rod of the push/pull operating device according to the present invention.
Figure 4:
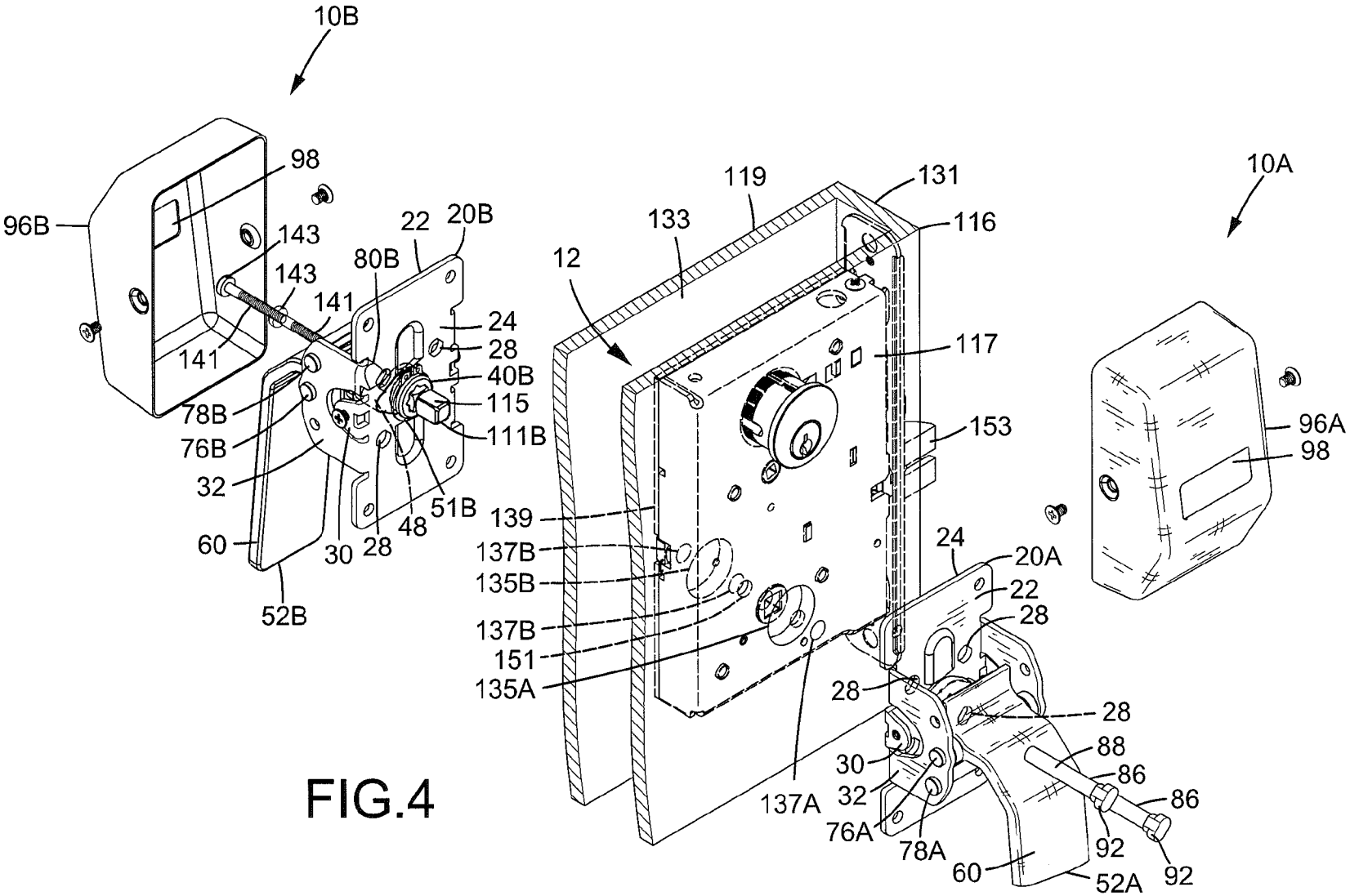
FIG. 4 shows an exploded, perspective view of the push/pull operating device, a portion of a door, and a latch device.

It can be appreciated that with first operational device 10A assembled to be of push type and with second operational device 10B assembled to be of pull type, door 116 is opened if it is moved towards second operational device 10B and is closed if it is moved towards first operational device 10A. Namely, the pivoting direction of first handle 52A from the release position to the pressing position by pushing first handle 52A is the same as the door opening direction, and the pivoting direction of second handle 52B from the release position to the pressing position by pulling second handle 52B is the same as the door opening direction. Thus, door 116 can be opened smoothly. However, installation of first and second operational devices 10A and 10B can be changed according to the change in the opening direction of door 116. Namely, first operational device 10A can be assembled to be of pull type, and second operational device 10B can be assembled to be of push type. Specifically, first limiting rod 78A can be extended through second limiting holes 38 of wings 32 of first bracket 20A, and positioning peg 82 of first actuating block 80A is engaged in second positioning hole 70 of first handle 52A (see phantom lines in FIG. 1). Pressing portion 84 of first actuating block 80A presses against and is located on top of protrusion 48 of first transmission member 40A. Thus, first operational device 10A becomes pull type. Likewise, second limiting rod 78B can be extended through first limiting holes 36 of wings 32 of second bracket 20B, and positioning peg 82 of second actuating block 80B is engaged in first positioning hole 68 of second handle 52B (see phantom lines in FIG. 2). Pressing portion 84 of second actuating block 80B presses against and is located below protrusion 48 of second transmission member 40B. Thus, second operational device 10B becomes push type.

By providing a plurality of non-circular mounting holes 28 in each of first and second brackets 20A and 20B, latch devices 12 having through-holes 151 in differing locations can align with two of mounting holes 28. Furthermore, engaging rods 86 and bolts 141 are used to fix first and second operational devices 10A and 10B to first and second sides 117 and 119 of door 116, providing enhanced overall structural strength. Thus, damage to first and second handles 52A and 52B during assembly or operation is less likely to occur.

Now that the basic teachings of the present invention have been explained, many extensions and variations will be obvious to one having ordinary skill in the art. For example, first actuating block 80A can be integrally formed on inner face 56 of first handle 52A as a single, monolithic piece. Likewise, second actuating block 80B can be integrally formed on inner face 56 of second handle 52B as a single, monolithic piece.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A push/pull operating device for driving a latch device, with the push/pull operating device comprising:

a first bracket including first and second surfaces, with a pivot hole extending from the first surface through the second surface of the first bracket, with a plurality of mounting holes provided around the pivot hole of the first bracket and having non-circular cross sections, with the first bracket further including two lateral sides extending between the first and second surfaces of the first bracket, with a wing formed on each of the two lateral sides of the first bracket, with each wing of the first bracket including an engagement hole, with the first bracket adapted to be mounted to a first side of a door, with the pivot hole of the first bracket adapted to align with a first through-hole in the first side of the door, with two of the plurality of mounting holes of the first bracket adapted to align with two second through-holes in the first side of the door;

a first transmission member including a pivotal portion pivotably received in the pivot hole of the first bracket, with the first transmission member further including a flange on an end of the pivotal portion of the first transmission member, with a protrusion formed on the flange of the first transmission member, with a driving hole extending from an end face of the flange through an end face of another end of the pivotal portion of the first transmission member, with the flange of the first transmission member located outside of the first surface of the first bracket, with the pivotal portion of the first transmission member adapted to be received in the first through-hole in the first side of the door;

a first spindle having first and second ends, with the first end of the first spindle engaged in the driving hole of the first transmission member, with the first spindle and the first transmission member jointly pivotable, with the second end of the first spindle adapted to be coupled to a follower of a latch device mounted in the door, with the latch device including a latch movable between a latching position outside the door and an unlatching position inside the door;

a first axle pivotably received in the engagement holes of the wings of the first bracket;

a first handle pivotably mounted to the first axle, with the first handle including a base having inner and outer faces, with an arm formed on the outer face of the first handle, with the first handle pivotable about a pivot axis defined by the first axle between a release position and a pressing position;

a first actuating block mounted to the inner face of the first handle, with the first actuating block including a pressing portion abutting the protrusion of the first transmission member, with the first actuating block pressing against and pivoting the first transmission member when the first handle pivots from the release position to the pressing position;

a second bracket including first and second surfaces, with a pivot hole extending from the first surface through the second surface of the second bracket, with a plurality of mounting holes provided around the pivot hole of the second bracket and having non-circular cross sections, with the second bracket further including two lateral sides extending between the first and second surfaces of the second bracket, with a wing formed on each of the two lateral sides of the second bracket, with each wing of the second bracket including an engagement hole, with the second bracket adapted to be mounted to a second side of the door, with the pivot hole of the second bracket adapted to align with a third through-hole in the second side of the door, with two of the plurality of mounting holes of the second bracket adapted to align with two fourth through-holes in the second side of the door;

a second transmission member including a pivotal portion pivotably received in the pivot hole of the second bracket, with the second transmission member further including a flange on an end of the pivotal portion of the second transmission member, with a protrusion formed on the flange of the second transmission member, with a driving hole extending from an end face of the flange through an end face of another end of the pivotal portion of the second transmission member, with the flange of the second transmission member located outside of the first surface of the second bracket, with the pivotal portion of the second transmission member adapted to be received in the third through-hole in the second side of the door;

a second spindle having first and second ends, with the first end of the second spindle engaged in the driving hole of the second transmission member, with the second spindle and the second transmission member jointly pivotable, with the second end of the second spindle adapted to be coupled to the follower of the latch device;

a second axle pivotably received in the engagement holes of the wings of the second bracket;

a second handle pivotably mounted to the second axle, with the second handle including a base having inner and outer faces, with an arm formed on the outer face of the second handle, with the second handle pivotable about a pivot axis defined by the second axle between a release position and a pressing position;

a second actuating block mounted to the inner face of the second handle, with the second actuating block including a pressing portion abutting the protrusion of the second transmission member, with the second actuating block pressing against and pivoting the second transmission member when the second handle pivots from the release position to the pressing position;

two engaging rods, with each of the two engaging rods including a body, a head, and a limiting portion between the body and the head with an abutment face formed at an intersection of the body and the head, with the limiting portion of each of the two engaging rods including, non-circular cross sections and not rotatably received in one of the plurality of mounting holes of the first bracket, with the abutment face of each of the two engaging rods abutting the first surface of the first bracket, with the bodies of the two engaging rods adapted to extend through the two second through-holes in the first side of the door and extend through two through-holes of the latch device;

two bolts engaged with the two engaging rods, with each of the two bolts including a head abutting the first surface of the second bracket, with the two bolts adapted to extend through the two fourth through-holes in the second side of the door and the two through-holes of the latch device, with the latch moving between the latching position and the unlatching position when either of the first and second spindles pivots, and with each of the two bolts in a tightened state, the head of each of the two engaging rods presses against the first bracket, and the head of each of the two bolts presses against the second bracket, securely fixing the first and second brackets to the door;

with each of the wings of the first bracket further including a first limiting hole located below engagement hole of the first bracket in a vertical direction and a second limiting hole located above the engagement hole of the first bracket in the vertical direction, with each of the wings of the second bracket further including a first limiting hole located below the engagement hole of the second bracket in the vertical direction and a second limiting hole located above the engagement hole of the second bracket in the vertical direction, with the push/pull operating device further comprising:

a first limiting rod mounted in the first limiting holes of the first bracket or the second limiting holes of the first bracket, and a second limiting rod mounted in the first limiting holes of the second bracket or the second limiting holes of the second bracket.

2. The push/pull operating device as claimed in claim 1, with the first handle further including first and second positioning holes and a fixing hole between the first and second positioning holes, with the first positioning hole of the first handle located below the fixing hole in the vertical direction, with the second positioning hole of the first handle located above the fixing hole in the vertical direction, with the first actuating block including a positioning peg, with a first screw extending through the first actuating block into the fixing hole of the first handle, with the positioning peg of the first actuating block engaged in one of the first and second positioning holes of the first handle, with the second handle further including first and second positioning holes and a fixing hole between the first and second positioning holes of the second handle, with the first positioning hole of the second handle located below the fixing hole of the second handle in the vertical direction, with the second positioning hole of the second handle located above the fixing hole of the second handle in the vertical direction, with the second actuating block including a positioning peg, with a second screw extending through the second actuating block into the fixing hole of the second handle, with the positioning peg of the second actuating block engaged in one of the first and second positioning holes of the second handle, with the positioning peg of the first actuating block engaged in the first positioning hole of the first handle, the pressing portion of the first actuating block is located below the protrusion of the first transmission member in the vertical direction, and the arm of the first handle pivots towards the first surface of the first bracket when the first handle pivots from the release position to the pressing position, with the positioning peg of the first actuating block engaged in the second positioning hole of the first handle, the pressing portion of the first actuating block is located on top of the protrusion of the first transmission member in the vertical direction, and the arm of the first handle pivots away from the first surface of the first bracket when the first handle pivots from the release position to the pressing position, with the positioning peg of the second actuating block engaged in the first positioning hole of the second handle, the pressing portion of the second actuating block is located below the protrusion of the second transmission member in the vertical direction, and the arm of the second handle pivots towards the first surface of the second bracket when the second handle pivots from the release position to the pressing position, and with the positioning peg of the second actuating block engaged in the second positioning hole of the second handle, the pressing portion of the second actuating block is located on top of the protrusion of the second transmission member in the vertical direction, and the arm of the second handle pivots away from the first surface of the second bracket when the second handle pivots from the release position to the pressing position.

* * * * *